US010352138B2

(12) United States Patent
McCarthy

(10) Patent No.: US 10,352,138 B2
(45) **Date of Patent: *Jul. 16, 2019**

(54) LIFT APPARATUS FOR DRIVING A DOWNHOLE RECIPROCATING PUMP

(71) Applicant: I-JACK TECHNOLOGIES INCORPORATED, Moosomin (CA)

(72) Inventor: Dan McCarthy, Moosomin (CA)

(73) Assignee: I-JACK TECHNOLOGIES INCORPORATED, Moosomin, Saskatchewan (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/059,891

(22) Filed: Aug. 9, 2018

(65) Prior Publication Data

US 2018/0347327 A1 Dec. 6, 2018

Related U.S. Application Data

(63) Continuation of application No. 15/656,252, filed on Jul. 21, 2017, now Pat. No. 10,072,487.

(Continued)

(51) Int. Cl.
*E21B 43/12* (2006.01)
*E21B 47/00* (2012.01)

(Continued)

(52) U.S. Cl.
CPC ..... *E21B 43/129* (2013.01); *E21B 47/0007* (2013.01); *F04B 1/12* (2013.01);

(Continued)

(58) Field of Classification Search
CPC combination set(s) only.
See application file for complete search history.

(56) References Cited

U.S. PATENT DOCUMENTS 1,619,475 A 3/1927 Hubbard
2,946,316 A 7/1960 Bruehl (Continued)

FOREIGN PATENT DOCUMENTS

CA 2165063 A1 3/1995
CA 2309970 C 7/1999

(Continued)

OTHER PUBLICATIONS

Brahma Compression Ltd., "CGR50 Casing Gas Recovery Unit", www.gascompressors.ca, before Apr. 21, 2016, 8 pages.

(Continued)

*Primary Examiner* — Giovanna C Wright
*Assistant Examiner* — Ronald R Runyan

(57) ABSTRACT

A lift apparatus and method for driving a downhole reciprocating pump is disclosed and includes a hydraulic cylinder having a piston and a hydraulic fluid port, the piston being coupled to a rod for driving the reciprocating pump, the piston being moveable between first and second ends of the cylinder in response to a flow of hydraulic fluid through the hydraulic fluid port. A variable displacement hydraulic pump is responsive to a displacement control signal to draw hydraulic fluid from a reservoir and to produce a controlled flow of hydraulic fluid at the outlet. The apparatus also includes a valve connected between the hydraulic fluid port and the reservoir, the valve being responsive to a valve control signal for controlling discharge of hydraulic fluid from the hydraulic fluid port of the cylinder back to the reservoir to facilitate movement of the piston through a downstroke away from the second end toward the first end of the cylinder. The apparatus further includes a first sensor located proximate the first end of the cylinder and operable to produce a first signal indicating a proximity of the piston to the first sensor, a second sensor located proximate the (Continued)

second end of the cylinder and operable to produce a second signal indicating a proximity of the piston to the second sensor, and a controller operably configured to generate the displacement control signal and the valve control signal in response to receiving the first signal and the second signal.

17 Claims, 7 Drawing Sheets

Related U.S. Application Data

(60) Provisional application No. 62/398,288, filed on Sep. 22, 2016.

(51) Int. Cl.

| | |
|---|---|
| ***F04B 1/32*** | (2006.01) |
| ***F04B 9/107*** | (2006.01) |
| ***F04B 41/02*** | (2006.01) |
| ***F04B 47/00*** | (2006.01) |
| ***F04B 49/06*** | (2006.01) |
| ***F04B 49/22*** | (2006.01) |
| ***F04B 1/12*** | (2006.01) |
| ***F04B 1/29*** | (2006.01) |
| ***F04B 47/04*** | (2006.01) |
| ***F04B 47/08*** | (2006.01) |

(52) U.S. Cl.
CPC ..... *F04B 1/295* (2013.01); *F04B 1/324* (2013.01); *F04B 9/107* (2013.01); *F04B 41/02* (2013.01); *F04B 47/00* (2013.01); *F04B 47/04* (2013.01); *F04B 47/08* (2013.01); *F04B 49/065* (2013.01); *F04B 49/22* (2013.01); *F04B 49/225* (2013.01); *F04B 2201/121* (2013.01); *F04B 2203/091* (2013.01)

(56) References Cited

U.S. PATENT DOCUMENTS

| | | | |
|---|---|---|---|
| 3,632,234 | A | 1/1972 | Lake |
| 3,801,230 | A | 2/1974 | Brown |
| 4,013,385 | A | 3/1977 | Peterson |
| 4,380,150 | A | 4/1983 | Carlson |
| 4,390,322 | A | 6/1983 | Budzich |
| 4,515,516 | A | 5/1985 | Perrine et al. |
| 4,516,473 | A | 5/1985 | Oneyama et al. |
| 4,949,805 | A | 8/1990 | Mather et al. |
| 5,238,372 | A | 8/1993 | Morris |
| 5,281,100 | A | 1/1994 | Diederich |
| 5,450,901 | A | 9/1995 | Ellwood |
| 5,481,873 | A | 1/1996 | Saruwatari et al. |
| 5,584,664 | A | 12/1996 | Elliott et al. |
| 5,622,478 | A | 4/1997 | Elliott et al. |
| 5,743,716 | A | 4/1998 | Smith |
| 5,782,612 | A | 7/1998 | Margardt |
| 5,807,083 | A | 9/1998 | Tomoiu |
| 5,868,122 | A | 2/1999 | Gram et al. |
| 6,408,736 | B1 | 6/2002 | Holt et al. |
| 6,422,313 | B1 | 7/2002 | Knight |
| 6,568,911 | B1 | 5/2003 | Brightwell et al. |
| 6,652,241 | B1 | 11/2003 | Alder |
| 7,255,540 | B1 | 8/2007 | Cooper |
| 7,527,482 | B2 | 5/2009 | Ursan et al. |
| 7,730,939 | B2 | 6/2010 | Merrick, III |
| 7,762,321 | B2 | 7/2010 | Fesi et al. |
| 7,766,079 | B2 | 8/2010 | Hoffarth |
| 8,046,990 | B2 | 11/2011 | Bollinger et al. |
| 8,047,820 | B2 | 11/2011 | Merrick, III |
| 8,066,496 | B2 | 11/2011 | Brown |
| 8,136,586 | B2 | 3/2012 | Merrick, III |
| 8,161,741 | B2 | 4/2012 | Ingersoll et al. |
| 8,297,362 | B1 | 10/2012 | Strider et al. |
| 8,387,375 | B2 | 3/2013 | Blieske |
| 8,851,860 | B1 | 10/2014 | Mail |
| 9,109,511 | B2 | 8/2015 | Ingersoll et al. |
| 9,359,876 | B2 | 6/2016 | Fink |
| 10,072,487 | B2 * | 9/2018 | McCarthy ..... E21B 43/129 |
| 2004/0162658 | A1 | 8/2004 | Newman |
| 2005/0103576 | A1 | 5/2005 | Engstrom |
| 2005/0175476 | A1 | 8/2005 | Patterson |
| 2007/0041847 | A1 | 2/2007 | Inoue et al. |
| 2009/0194291 | A1 | 8/2009 | Fesi et al. |
| 2009/0246049 | A1 | 10/2009 | Merrick, III |
| 2010/0172771 | A1 | 7/2010 | Hoffarth |
| 2012/0204548 | A1 | 8/2012 | Turnis et al. |
| 2012/0224977 | A1 | 9/2012 | Sotz et al. |
| 2012/0247785 | A1 | 10/2012 | Schmitt |
| 2013/0094978 | A1 | 4/2013 | Hoffarth |
| 2014/0093395 | A1 | 4/2014 | Leavy et al. |
| 2014/0231093 | A1 | 8/2014 | Hoell |
| 2014/0294635 | A1 | 10/2014 | Rietkerk |
| 2014/0353391 | A1 | 12/2014 | Burklin et al. |
| 2015/0233368 | A1 | 8/2015 | Gallaway |
| 2015/0240799 | A1 | 8/2015 | Obrejanu et al. |
| 2016/0032911 | A1 | 2/2016 | McCoy |

FOREIGN PATENT DOCUMENTS

| | | | |
|---|---|---|---|
| CA | 2353391 | A1 | 6/2000 |
| CA | 2331931 | A1 | 7/2002 |
| CA | 2379766 | C | 10/2004 |
| CA | 2644346 | A1 | 5/2010 |
| CA | 2803208 | A1 | 2/2012 |
| CA | 2891110 | A1 | 5/2013 |
| CA | 2599447 | C | 7/2013 |
| CA | 2843321 | C | 2/2015 |
| CA | 2861781 | C | 3/2016 |
| CN | 2445111 | Y | 8/2001 |
| CN | 1326050 | A | 12/2001 |
| CN | 201103527 | Y | 8/2008 |
| CN | 201103528 | Y | 8/2008 |
| CN | 201225264 | Y | 4/2009 |
| CN | 202108682 | U | 1/2012 |
| CN | 202360325 | Y | 8/2012 |
| CN | 202674817 | U | 1/2013 |
| WO | 2011/079267 | A1 | 6/2011 |
| WO | 2011/079271 | A2 | 6/2011 |
| WO | 2012/012896 | A1 | 2/2012 |
| WO | 2013/064748 | A1 | 5/2013 |
| WO | 2013/071134 | A1 | 5/2013 |
| WO | 2013/177268 | A1 | 11/2013 |
| WO | 2014/113545 | A1 | 7/2014 |
| WO | 2016/037500 | A1 | 3/2016 |

OTHER PUBLICATIONS

Brittania Industries 2009 Inc., "Casing Gas Compressor Packages", www.brittaniaindustries.com, before Apr. 21, 2016, 2 pages.

Broadwind Energy and Safe North America, "CNG Boost™ (Hydraulic Compressor) System Operation and Technology Overview", www.bwen.com and www.safegas.it/en/, before Apr. 21, 2016, 3 pages.

Karl Bratt; Jonathan Haines; Andrew Hall; and Brandon Koster, "Project Proposal & Feasibility Study NaturaFill: Fuel for Thought", © 2013, Karl Bratt, Jonathan Haines, Andrew Hall, Brandon Koster, and Calvin College, Updated: Dec. 9, 2013, 59 pages.

Karl Bratt; Jonathan Haines; and Brandon Koster, "Final Design Report NaturaFill: Fuel for Thought", © 2014, Karl Bratt, Jonathan Haines, Brandon Koster, and Calvin College, Updated: May 15, 2014, 112 pages.

Chemac Inc., "Hofer Piston compressors with hydraulic drive unit", www.chemacinc.com, before Apr. 21, 2016, 4 pages.

Corken, Inc. (A Unit of IDEX Corporation), "Sour Gas Compressors Oil & Natural Gas Applications", http://www.corken.com, Jul. 2015, 8 pages.

Hans Turck GMBH & Co. KG, "Inductive sensor BI5-EM18-Y1X-H1141", www.turck.com, before Apr. 21, 2016, 4 pages.

Compact Compression Inc., "Casing Gas Compression", http://www.compactcompression.com, before Apr. 21, 2016, 32 pages.

(56) References Cited

OTHER PUBLICATIONS

Permian Production Equipment, Inc., "The Hydraulic Beam Gas Compressor® Your Solution When More Production is the Question", www.hydraulic.beamgascompressor.com, before Apr. 21, 2016, 4 pages.
Linde Hydraulics GMBH & Co. KG, "HPV-02. Variable pumps for closed loop operation.", http://www.linde-hydraulics.com, before Apr. 21, 2016, 36 pages.
Hoerbiger, "Ring and packing Sealing systems for reciprocating compressors", http://www.hoerbiger.com, before Apr. 21, 2016, 24 pages.
Krzysztof Palka, "Understanding Sucker Rod Pump Operation with Hydraulic Jack", © Krzysztof Palka 2015, 27 pages.
I-Jack Technologies Incorporated, "IJack DGAS Product Manual Publication No. 800-0030 Rev 2.1", before before May 31, 2017, 34 pages.
Final Office Action issued by the U.S. Patent and Trademark Office dated Nov. 24, 2017 in connection with U.S. Appl. No. 15/656,252, 21 pages.
Non-Final Office Action issued by the U.S. Patent and Trademark Office dated Sep. 1, 2017 in connection with U.S. Appl. No. 15/656,252, 25 pages.
Non-Final Office Action issued by the U.S. Patent and Trademark Office dated Jan. 17, 2018 in connection with U.S. Appl. No. 15/786,369, 13 pages.
Non-Final Office Action issued by the U.S. Patent and Trademark Office dated Feb. 20, 2018 in connection with U.S. Appl. No. 15/822,035, 40 pages.

* cited by examiner

LIFT APPARATUS FOR DRIVING A DOWNHOLE RECIPROCATING PUMP

BACKGROUND

1. Field

This disclosure relates generally to driving a downhole reciprocating pump and more particularly to a lift apparatus for driving a downhole reciprocating pump.

2. Description of Related Art

Downhole reciprocating pumps may be used to pump fluids from a borehole or well to the surface. In hydrocarbon recovery operations, conventional rocking arm pumpjacks have been used to drive downhole pumps. In some implementations hydraulic lift systems have replaced rocking arm pumpjacks. Hydraulic lift systems may include a cylinder having a movable piston responsive to a flow of a driving fluid, wherein movement of the piston drives the downhole reciprocating pump. There remains a need for alternative lift systems for driving downhole pumps.

SUMMARY

In accordance with one disclosed aspect there is provided a lift apparatus for driving a downhole reciprocating pump. The apparatus includes a hydraulic cylinder having a piston and a hydraulic fluid port, the piston being coupled to a rod for driving the reciprocating pump, the piston being moveable between first and second ends of the cylinder in response to a flow of hydraulic fluid through the hydraulic fluid port. The apparatus also includes a variable displacement hydraulic pump coupled to receive a substantially constant rotational drive from a prime mover for operating the hydraulic pump, the hydraulic pump having an outlet and being responsive to a displacement control signal to draw hydraulic fluid from a reservoir and to produce a controlled flow of hydraulic fluid at the outlet. The apparatus also includes a hydraulic fluid line connected to deliver hydraulic fluid from the outlet of the hydraulic pump through the hydraulic fluid port to the cylinder for causing the piston to move through an upstroke away from the first end and toward the second end of the cylinder. The apparatus further includes a valve connected between the hydraulic fluid port and the reservoir, the valve being responsive to a valve control signal for controlling discharge of hydraulic fluid from the hydraulic fluid port of the cylinder back to the reservoir to facilitate movement of the piston through a downstroke away from the second end toward the first end of the cylinder. The valve is operable to prevent flow of hydraulic fluid through the valve during the upstroke and the hydraulic pump is operable to prevent flow of hydraulic fluid back into the outlet of the hydraulic pump during the downstroke.

The hydraulic fluid port may include a first port for connecting to the hydraulic fluid line and a second port for connecting to the valve.

The hydraulic fluid line may include a common portion in communication with the hydraulic fluid port, the common portion carrying fluid flow from the hydraulic pump during the upstroke and to the valve during the downstroke.

The hydraulic fluid line may be routed between the outlet of the hydraulic pump and the hydraulic fluid port through at least one bend, the at least one bend having a bend radius of at least about 25 mm to reduce flow losses within the hydraulic fluid line.

The hydraulic pump may be configured to produce a unidirectional flow of fluid at the outlet having a flow rate ranging from a substantially no flow condition to a maximum flow rate in proportion to the displacement control signal.

The hydraulic pump may include a swashplate movable through a range of angles between 0° corresponding to the substantially no flow condition to a maximum angle corresponding to the maximum flow rate and the hydraulic pump may be configured to prevent the swashplate being angled at less than 0° for preventing flow back into the outlet and through the hydraulic pump.

The hydraulic fluid line may include a check valve disposed between the outlet of the pump and the hydraulic fluid port, the check valve being operable to permit flow from the outlet to the hydraulic fluid port during the upstroke while preventing flow of hydraulic fluid back into the outlet of the hydraulic pump during the downstroke.

The apparatus may include a first sensor located proximate the first end of the cylinder and operable to produce a first signal indicating a proximity of the piston to the first sensor, a second sensor located proximate the second end of the cylinder and operable to produce a second signal indicating a proximity of the piston to the second sensor, and a controller operably configured to generate the displacement control signal and the valve control signal in response to receiving the first signal and the second signal.

The first and second sensors are positioned proximate to but spaced inwardly from the respective first and second ends of the cylinder to cause the first and second signals to be generated in when the piston may be in proximity to the respective first and second ends of the cylinder.

The controller may be operably configured to generate a displacement control signal having a time varying waveform for controlling the upstroke, the waveform including a first ramped portion that causes the hydraulic pump to deliver an increasing flow of hydraulic fluid for accelerating the piston away from the first end of the cylinder, a constant portion that causes the hydraulic pump to deliver a substantially constant flow for moving the piston at a substantially constant velocity, and a second ramped portion that causes the hydraulic pump to deliver a reducing flow for decelerating the piston as the piston approaches the second end of the cylinder.

The controller may be operably configured to generate the constant portion of the waveform to target a desired velocity of the piston for the upstroke based on a calculated velocity of the piston during a previous upstroke of the piston, the velocity being calculated based on the first and second signals.

The controller may be operably configured to receive operator input of one of the desired velocity and an upstroke time.

The controller may be operably configured to, in response to receiving the second signal, commence the second ramped portion following a delay period.

The controller may be operably configured to calculate the delay period based on a calculated velocity of the piston between the first and second sensors during a current upstroke of the piston.

The controller may be operably configured to generate the first and second ramped portions of the waveform for the upstroke based on the first and second signals received during a previous upstroke of the piston.

The controller may be operably configured to generate a valve control signal having a time varying waveform for controlling the downstroke, the waveform including a first ramped portion that causes the valve to permit an increasing flow of hydraulic fluid permitting the piston to accelerate away from the second end of the cylinder, a constant portion that causes the valve to permit a substantially constant flow for moving the piston at a substantially constant velocity, and a second ramped portion that causes the valve to permit a reducing flow for decelerating the piston as the piston approaches the first end of the cylinder.

The controller may be operably configured to generate the constant portion of the waveform for targeting a desired velocity of the piston for the downstroke based on a calculated velocity of the piston during a previous downstroke of the piston, the velocity being calculated based on the first and second signals.

The controller may be operably configured to receive operator input of one of a desired velocity and a downstroke time.

The controller may be operably configured to, in response to receiving the first signal, commence the second ramped portion following a delay period.

The controller may be operably configured to calculate the delay period based on a calculated velocity of the piston between the second and first sensors during the downstroke of the piston.

The controller may be operably configured to generate the first and second ramped portions of the waveform for the downstroke based on the first and second signals received during a previous downstroke of the piston.

The valve may include an electrically controllable proportional throttle valve.

The hydraulic pump may include a swashplate pump an angle of the swashplate may be configurable over a range of angles in response to the displacement control signal and the range of angles is constrained to produce a unidirectional flow at the outlet.

In accordance with another disclosed aspect there is provided a method for operating a pumpjack lift including a hydraulic cylinder having a piston and a hydraulic fluid port, the piston being coupled to a rod for driving a down-hole reciprocating pump. The method involves producing a displacement control signal operable to cause a variable displacement hydraulic pump to draw hydraulic fluid from a reservoir and to produce a controlled flow of hydraulic fluid at an outlet of the hydraulic pump, the hydraulic pump being coupled to receive a substantially constant rotational drive from a prime mover. The method also involves delivering hydraulic fluid from the outlet through a hydraulic fluid line connected to the hydraulic fluid port of the cylinder to cause the piston to move through an upstroke away from a first end and toward a second end of the cylinder. The method further involves producing a valve control signal for controlling discharge of hydraulic fluid from the hydraulic fluid port of the cylinder through a valve connected between the hydraulic fluid port and the reservoir back to the reservoir to facilitate movement of the piston through a downstroke away from the second end and toward the first end of the cylinder. The method further involves preventing flow of hydraulic fluid through the valve during the upstroke and preventing flow of hydraulic fluid back into the outlet of the hydraulic pump during the downstroke.

Other aspects and features will become apparent to those ordinarily skilled in the art upon review of the following description of specific disclosed embodiments in conjunction with the accompanying figures.

BRIEF DESCRIPTION OF THE DRAWINGS

In drawings which illustrate disclosed embodiments.

DETAILED DESCRIPTION

Figure 1:
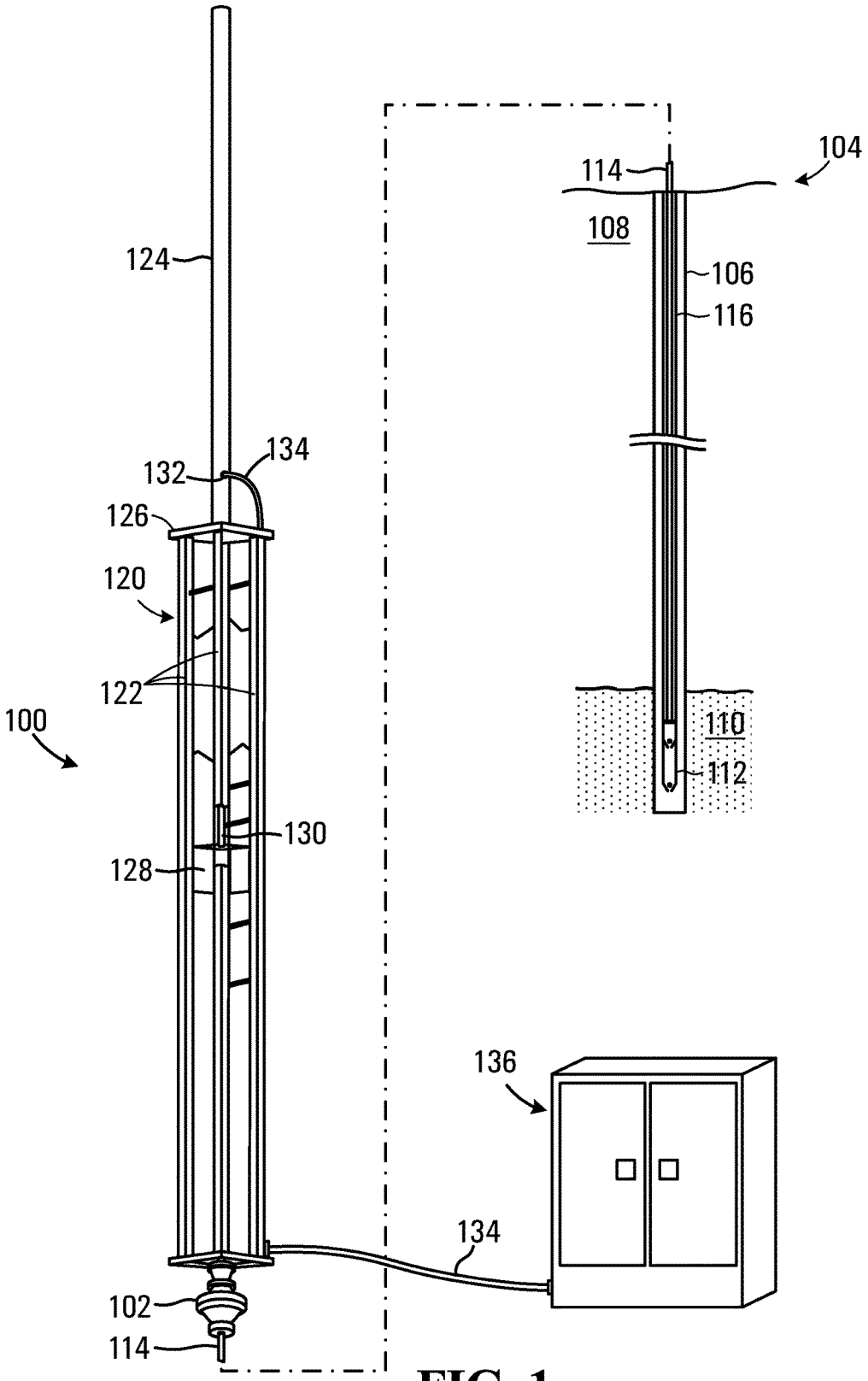
FIG. 1 is a perspective view of a lift apparatus in accordance with one disclosed embodiment.

Referring to FIG. 1, a lift apparatus according to one disclosed embodiment is shown generally at 100. The lift apparatus 100 may be mounted at a wellhead 102 of a well shown in cross section at 104 as an insert. The well 104 has a well casing 106 extending downwardly through a land formation 108 to access a subterranean reservoir 110 from which it is desired to recover fluids such as hydrocarbons, natural gas, and/or water. In one embodiment the well casing may extend a few hundred meters into the land formation 108. A down-hole reciprocating pump 112 is coupled to a sucker rod 114, which is actuated by the lift apparatus 100 to produce the fluid upwardly through a tube 116 back to the wellhead 102.

The lift apparatus 100 includes a frame 120 having a plurality of upright supports 122. A hydraulic cylinder 124 is mounted on a platform 126 supported by the plurality of upright supports 122. The lift apparatus 100 also includes a carriage 128 mounted for movement within the frame 120. The hydraulic cylinder 124 includes a cylinder rod 130, which is coupled to the carriage 128 (as shown in cut away view in FIG. 1). The carriage 128 provides for coupling between the cylinder rod 130 and the sucker rod 114 and constrains lateral movement of the cylinder rod 130, thus reducing wear of the hydraulic cylinder 124 during operation.

The hydraulic cylinder 124 includes a hydraulic fluid port 132 for coupling to a hydraulic fluid line 134. The hydraulic fluid line 134 is routed through the frame 120 to an enclosure 136 that houses hydraulics and a controller (not shown in FIG. 1), which together with the hydraulic cylinder 124 make up a hydraulic fluid circuit for driving the lift apparatus 100.

Figure 2:
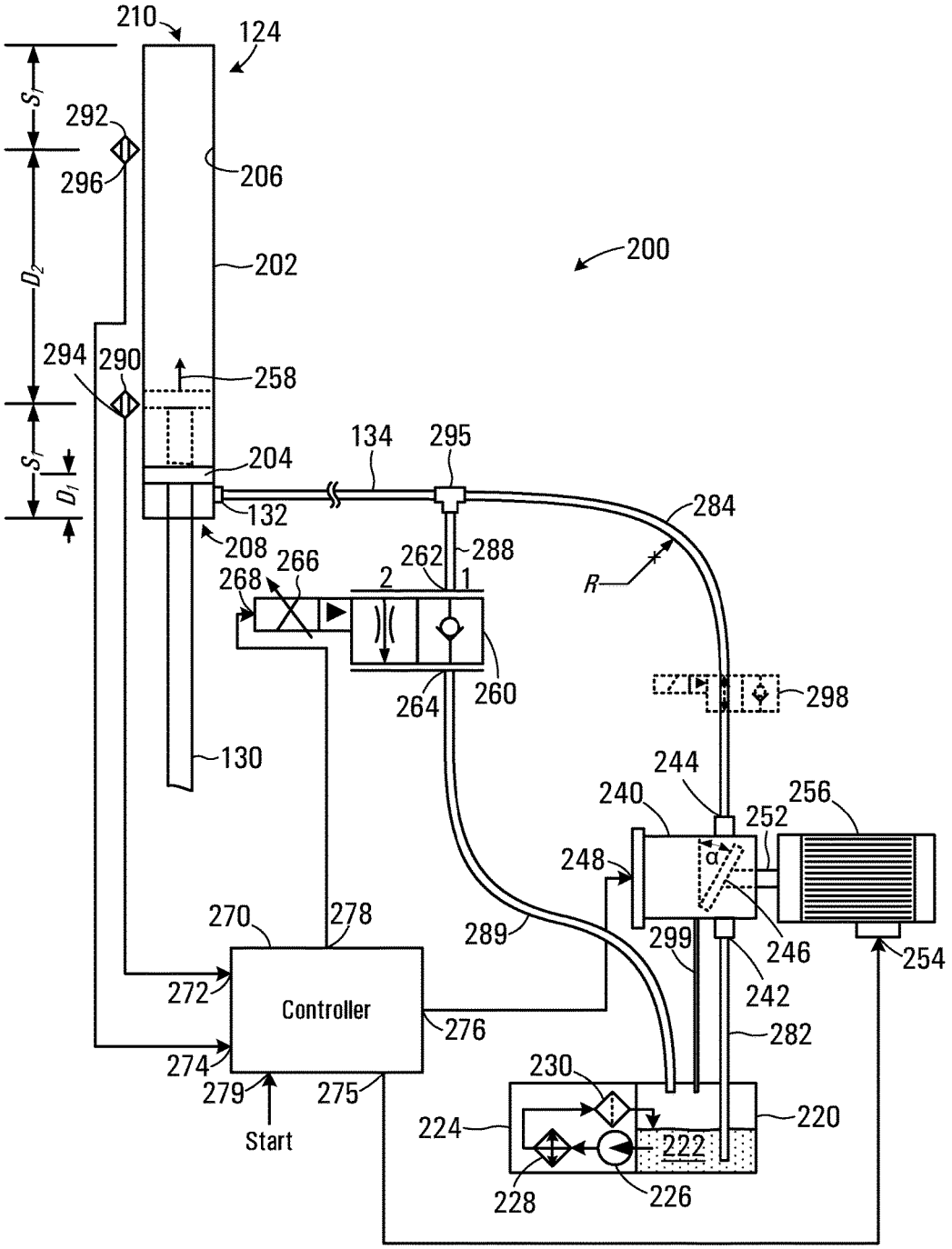
FIG. 2 is a schematic view of a fluid circuit of the lift apparatus of FIG. 1 while executing an upstroke process.

The hydraulic fluid circuit is shown schematically in FIG. 2 at 200. Referring to FIG. 2, the hydraulic cylinder 124 includes a cylinder housing 202 and a piston 204, disposed within a bore 206 of the cylinder housing. The hydraulic fluid port 132 is coupled to the hydraulic fluid line 134 and the piston 204 is movable between a first end 208 and a second end 210 of the cylinder housing 202 in response to receiving a flow of fluid at the hydraulic fluid port 132. In the embodiment shown, the hydraulic cylinder 124 includes a single hydraulic fluid port 132, but in other embodiments the cylinder may have more than one port.

The piston 204 is coupled to the cylinder rod 130 such that movement of the piston causes corresponding movement of the rod. In the embodiment shown in FIG. 1 the cylinder rod 130 is connected to the sucker rod 114 via the carriage 128, but various other configurations may be implemented depending on the particular application.

In the embodiment shown, the reservoir 220 holds a hydraulic fluid 222, which may be any suitable fluid that is substantially incompressible and suitable for driving the hydraulic cylinder 124. The hydraulic fluid 222 may include anti-wear additives or constituents and provide for transfer heat from within fluid circuit 200 and the reservoir 220. In some embodiments, the hydraulic fluid 222 may be SKYDROL™ airplane fluid, automatic transmission fluid, mineral oil, biodegradable hydraulic oil, and other synthetic and semi-synthetic fluids. The reservoir 220 further includes a sub-circuit 224 configured to cool and filter the hydraulic fluid 222. In the embodiment shown, the sub-circuit 224 includes a pump 226, a heater/cooler 228 and a filter 230, which are connected to recirculate the hydraulic fluid 222 in the reservoir 220 while providing filtering and heating or cooling of the fluid. The heater/cooler 228 is operable to maintain the hydraulic fluid 222 within a desired temperature range, thus maintaining a desired viscosity. For example, in some embodiments, the heater/cooler 228 may be operable to cool the hydraulic fluid when the temperature goes above about 50° C. and to stop cooling when the temperature reduces below about 45° C. The heater/cooler 228 may further be operable to heat the hydraulic fluid when the temperature reduces below about −10° C. The hydraulic fluid may be selected to maintain a viscosity of between about 20 and about 40 $mm^2s^{-1}$ over this temperature range. The filter 230 is operable to remove contaminants from the hydraulic fluid 222 and cooled and filtered hydraulic fluid 222 is returned to the reservoir 220.

The hydraulic pump 240 includes an inlet 242 for drawing hydraulic fluid 222 from the reservoir 220 via a hydraulic fluid line 282 and an outlet 244 for delivering a pressurized flow of hydraulic fluid to a hydraulic fluid line 284. The pump 240 is implemented using a variable-displacement hydraulic pump capable of producing a controlled flow hydraulic fluid at the outlet 244. In one embodiment, the pump 240 may be an axial piston pump having a swashplate 246 that is configurable at a varying angle α. For example the pump 240 may be a HPV-02 variable pump manufactured by Linde Hydraulics GmbH & Co. KG of Germany, which is operable to deliver displacements of hydraulic fluid of up to about 281 cubic centimeters per revolution at pressures of up to about 500 bar. In other embodiments, the pump 240 may be any other variable displacement pump, such a variable piston pump or a rotary vane pump, for example. For the HPV-02 variable pump, the angle α of the swashplate 246 may be adjusted from between about 0°, corresponding to a substantially no flow condition, and a maximum angle of about 21°, which corresponds to a maximum flow rate condition at the outlet 244. In the embodiment shown the swashplate 246 is constrained to positive angular displacements by preventing the swashplate from moving past α=0°. As such fluid flow back through the pump 240 from the outlet 244 to the inlet 242 is restricted and when the angle α of the swashplate 246 is at 0°, the pump 240 produces no flow of hydraulic fluid at the outlet 244 and also substantially prevents backflow of hydraulic fluid though the pump 240 back to the reservoir 220. The hydraulic pump 240 may thus be configured to produce a unidirectional flow of fluid at the outlet 244. In some embodiments, the hydraulic pump 240 will permit a small amount of leakage when the swashplate 246 is at 0°.

In this embodiment the pump 240 includes an electrical input 248 for receiving a displacement control signal. The displacement control signal at the input 248 is operable to drive a coil of a solenoid (not shown) for controlling the displacement of the pump 240 and thus a hydraulic fluid flow rate produced at the outlet 244. The electrical input 248 is connected to a 24 VDC coil within the hydraulic pump 240, which is actuated in response to a controlled pulse width modulated (PWM) excitation current of between about 232 mA ($i_{0u}$) for a no flow condition and about 600 mA ($i_u$) for a maximum flow condition.

For the Linde HPV-02 variable pump, the swashplate 246 is actuated to move to an angle α only when the pressure at the port 244 has reached a threshold pressure, whereafter the angle α of the swashplate 246 is restricted by a level of the displacement control signal at the input 248, thus controlling the flow rate produced at the outlet 244. A version of the Linde HPV-02 pump has been supplied by the manufacturer including an internal spring to provide sufficient force (equivalent to a pressure of about 200 psi) for activating the swashplate when the pressure at the outlet 244 is less than the threshold pressure. This situation usually only arises when the lift apparatus 100 is first started up and the piston is not subjected to any pressure due to the load of the sucker rod 114 being supported by the frame 120. During operation of the lift apparatus 100 the load pressure of the sucker rod 114 will generally be sufficient (typically greater than 200 psi) to provide the necessary threshold pressure at the outlet 244 for actuating the swashplate. In one embodiment, when the pressure at the port 244 is at least about 150 psi, the angle α of the swashplate 246 may be proportionally controlled between 0° and 21° in response to an electrical displacement control signal at the electrical input 248. The corresponding flow rate at the outlet 244 thus ranges from no flow for a displacement control signal of at or below 232 mA and maximum flow for a displacement control signal of 600 mA. The Linde HPV-02 pump also has a load sense input for sensing a load pressure. However in this embodiment the load sense input is not used to limit the displacement of the pump and the load sense input is thus disabled.

In a swashplate pump, rotation of the swashplate drives a set of axially oriented pistons (not shown) to generate fluid flow. In the embodiment shown in FIG. 2, the swashplate 246 of the pump 240 is driven by a rotating shaft 252, which is coupled to the prime mover 256 for receiving a drive torque. In this embodiment the prime mover 256 is an electric motor but in other embodiments, the prime mover 256 may be implemented using a diesel engine, gasoline engine, or a gas driven turbine, for example. The prime mover 256 is responsive to a control signal received at a control input 254 to deliver a controlled substantially constant rotational speed and torque at the shaft 252. The prime mover 256 may be selected to provide some torque margin so as to minimize any changes in rotational speed when higher loads are encountered on the sucker rod 114 during downhole pumping operations. While there may be some minor variations in rotational speed, the shaft 252 is driven at a speed that is substantially constant and produces a substantially constant flow of fluid at the outlet 244. In one embodiment the prime mover 256 is selected and configured to deliver a rotational speed of about 1750 rpm which is controlled to be substantially constant within about ±1%.

The inlet 242 of the pump 240 is in fluid communication with the reservoir 220 via a fluid line 282, and draws hydraulic fluid 222 from the reservoir 220. When the swashplate 246 is angled at an angle $\alpha>0°$, a flow of fluid is delivered to the fluid line 284 via the outlet 244. The hydraulic fluid line 284 is connected through a tee or wye coupling 295 to the fluid line 134, which is in turn connected to the hydraulic fluid port 132 for delivering hydraulic fluid to the cylinder 124.

The lift apparatus 100 also includes a valve 260 having ports 262 and 264. The port 262 is connected via the fluid line 134 to the tee coupling 295. In this embodiment the valve 260 is an electrically controllable proportional throttle valve, which is actuated by a solenoid 266 responsive to a valve control signal received at an input 268 for configuring the valve in a first state ("1") or a second state ("2"). The valve is shown configured in the first state in FIG. 2, where the port 262 and 264 are connected through a check valve that prevents flow from port 262 through port 264 and back to the reservoir 220 via a fluid line 289. In the second state the valve 260 is configured to function as a proportional throttle valve permitting a controlled flow in response to the valve control signal received at the input 268. For example, the valve 260 may be operably configured to adjust the orifice size in response to a level of the valve control signal. The valve 260 may be implemented using a model FPJK valve made by Sun Hydraulics Corporation of United States of America, which is actuated by a 24 VDC solenoid coil responsive to a pulse width modulated (PWM) excitation current level between about 100 mA ($i_{0d}$) for a no flow condition and about 590 mA ($i_d$) for a maximum flow condition. The FPJK valve remains in the first state while the valve control signal provides a current $i_{0d}$ of less than 100 mA, and configures in the second state to permit flow from port 262 to 264 in proportion to a current of between 100 mA and 590 mA received at the input 268.

When the valve 260 is actuated to configure in the second state, hydraulic fluid flows out of the hydraulic fluid port 132 and through hydraulic fluid lines 134 and 288, through the valve and fluid line 289 back to the reservoir 220. In the embodiment shown, hydraulic fluid line 134 thus provides a common portion in communication with the hydraulic fluid port 132 for carrying fluid flow from the outlet 244 of the hydraulic pump 240 during the upstroke and to the valve 260 during the downstroke.

The hydraulic fluid circuit 200 also includes a first sensor 290 located proximate, but spaced apart from the first end 208 of the hydraulic cylinder 124 by a distance $S_1$, and a second sensor 292 located proximate, but spaced apart from the second end 210 by a distance of $S_2$. The sensors 290 and 292 are thus spaced apart from each other by a distance $D_2$. In one embodiment, the cylinder housing 202 may have a length of 150 inches (3.8 meters), $S_1$ may be about 36 inches (0.9 meters), $S_2$ may be about 33 inches (0.8 meters), and $D_2$ may be about 81 inches (2 meters). In this embodiment, the first and second sensors 290 and 292 are implemented using proximity sensors, which generate output signals at respective outputs 294 and 296 when the piston 204 is located proximate the respective sensors. In one embodiment the first and second sensors 290 & 292 may be implemented using inductive proximity sensors, such as model NI15-EM30E-YOX-H1141 sensors manufactured by Turck, Germany. These inductive sensors are operable to generate proximity signals responsive to the proximity of a metal portion of the carriage 128.

The hydraulic fluid circuit 200 also includes a controller 270 that is operable to receive the proximity signal from the output 294 of the sensor 290 at an input 272 and the proximity signal from the output 296 of the sensor 292 at an input 274 of the controller. The controller 270 also produces the displacement control signal at an output 276 for controlling the pump 240 and produces the valve control signal at an output 278 for controlling the valve 260. The controller 270 also includes an input 279 for receiving a start signal operable to cause the controller to start operation of the lift apparatus 100 and an output 275 for producing a control signal for controlling operation of the prime mover 256. The start signal may be provided by a start button within the enclosure 136 that is depressed by an operator on site to commence operation. Alternatively, the start signal may be received from a remotely located controller, which may be communication with the controller via a wireless or wired connection. The controller 270 may be implemented using a microcontroller circuit although in other embodiments, the controller may be implemented as an application specific integrated circuit (ASIC) or other integrated circuit, a digital signal processor, an analog controller, a hardwired electronic or logic circuit, or using a programmable logic device or gate array, for example.

Figure 3:
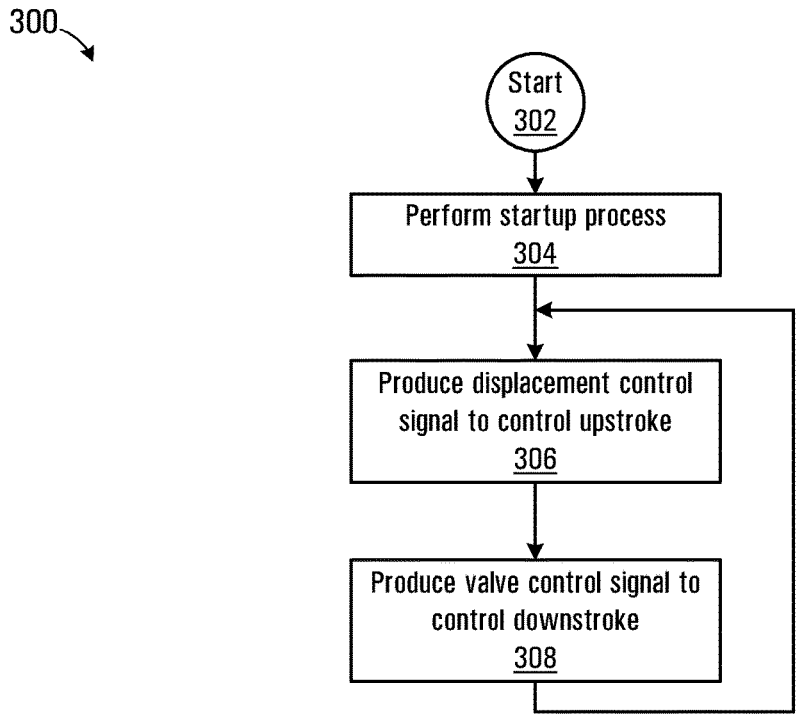
FIG. 3 is a flowchart of a process for operating the lift apparatus shown in FIG. 2.

Referring to FIG. 3, a process for operating the lift apparatus 100 is shown at 300. The process 300 begins at 302 when an operator causes the lift apparatus 100 to start operation in response to receiving the start signal at the input 279. As shown at 304, the controller 270 then performs a startup process. In one embodiment the startup process involves producing a displacement control signal at the output 276, which causes the swashplate 246 to adjust to angle $\alpha=0°$. The startup process also involves producing a valve control signal at the output 278 that causes the valve 260 to configure in the first state as shown in FIG. 1. Once the valve 260 and hydraulic pump 240 are configured, the controller 270 generates a signal at the output 275 for starting the prime mover 256 such that a rotational torque is delivered to drive the shaft 252 at a substantially constant rotational speed. Under these conditions, hydraulic fluid is prevented from flowing into the outlet 244 of the hydraulic pump 240 due to the swashplate angle being at 0°. Similarly when configured in the first state, the valve 260 acts as a check valve between the valve ports 262 and 264 preventing flow of hydraulic fluid back to the reservoir 220. The piston 204 thus remains at a position proximate the first end 208 of the hydraulic cylinder 124 during the startup process, as shown in FIG. 2.

As shown at 306 the controller 270 then produces a displacement control signal for controlling the upstroke of the piston 204. In one embodiment the displacement control signal has a waveform as shown at 400 in FIG. 4. The startup functions shown at 304 are performed during a first time period 402, following which the displacement control signal is set to a current level of $i_{0u}$ at a time $t_1$ and the upstroke commences. The controller 270 generates a first ramped portion 404 of the waveform that causes the angle $\alpha$ of the swashplate 246 to increase from 0° to a positive angle causing a hydraulic fluid flow at the outlet 244. The valve control signal remains at or below a current level of $i_{0d}$ preventing the fluid from flowing through the valve 260 back to the reservoir 220. The weight of the cylinder rod 130 and sucker rod 114 on the piston 204 causes hydraulic fluid in the cylinder 124 to be pressurized causing a pressure at the outlet 244, which should be sufficient to actuate movement of the swashplate 246 in response to the displacement control signal. A controlled flow of hydraulic fluid is thus generated at the outlet 244 and passes through the hydraulic fluid lines 284, tee coupling 295, and line 134 into the hydraulic fluid port 132 causing the piston 204 to move through an upstroke away from a first end 208 and toward a second end 210 of the cylinder in the direction indicated by arrow 258. The movement 258 is controlled in proportion to the increasing current of the displacement control signal provided by the first ramped portion 404 of the waveform 400. At a time $t_2$, the waveform 400 reaches a current level $i_u$ and then remains at a constant current level for a constant portion 406 until a time $t_3$ is reached. During the constant portion 406, the angle $\alpha$ of the swashplate 246 is held constant and the fluid flow rate at the outlet 244 is also substantially constant causing the piston 204 to move upwardly at a substantially constant velocity. At a time $t_3$ when the piston 204 is nearing the second end 210 a second ramped portion 408 of the waveform 400 begins. The second ramped portion 408 reduces the current, causing the fluid flow rate to reduce and decelerating the piston 204 until at $i_{0u}$ the piston upstroke ends with the piston being located proximate the second end 210. At $t_4$ the current of the waveform 400 is again at $i_{0u}$ and the swashplate 246 angle $\alpha$ is adjusted to 0° such that hydraulic fluid is prevented from flowing back into the outlet 244 of the hydraulic pump 240 The piston 204, cylinder rod 130, and sucker rod 114 at the second end 210 of the cylinder 124 are thus held proximate the second end 210 of the hydraulic cylinder 124 for a delay period $t_{du}$.

As shown at 308 the controller 270 then produces the valve control signal for controlling the downstroke of the piston 204. The valve control signal has a waveform as shown at 420 in FIG. 4. At time $t_5$ the controller 270 generates a first ramped portion 422 of the waveform 420, which causes the valve 260 to change configuration from the first state to the second state when the waveform reaches a current level of $i_{0d}$. Referring to FIG. 5, the fluid circuit 200 is shown with the valve 260 configured in the second state. The piston 204 is still positioned proximate the second end 210 following the upstroke and the orifice valve begins to open as the current level of the waveform 420 increases above $i_{0d}$ permitting hydraulic fluid to flow through the hydraulic fluid line 134, the tee coupling 295 and fluid line 288, and through the valve via the fluid line 289 back to the reservoir 220. In the meantime the waveform 400 of the displacement control signal remains at a current level $i_{0u}$, thus causing the swashplate 246 to remain at angle $\alpha$=0° preventing the flow of hydraulic fluid through the valve 260 and thus preventing the fluid from flowing back into the outlet 244 and through the hydraulic pump 240. Proportional control of the orifice in response to the current level during a remaining portion of the first ramped portion of the waveform 420 permits the piston 204 to accelerate away from the second end 210 facilitating movement of the piston through a downstroke away from the second end 210 and toward the first end 208 of the cylinder in a direction indicated by the arrow 259. Hydraulic fluid thus flows out of the hydraulic fluid port 132 and through the lines 134, 288, and 289 back to the reservoir 220. At a time $t_6$, the current level of the waveform 400 reaches a constant current level $i_d$ and remains at the constant current level for a constant portion 424 until a time $t_7$. During the constant portion 424, the valve orifice opening size is maintained to permit a constant flow rate at the port 264 of the valve 260 allowing the piston 204 to move downwardly at a substantially constant velocity. At a time $t_7$ when the piston 204 is nearing the first end 208 a second ramped portion 426 of the waveform 420 begins. The second ramped portion 426 reduces in current level, thus causing the fluid flow rate to reduce thereby decelerating the piston 204. At a time $t_8$ the waveform 420 reaches $i_{0d}$ and the piston downstroke ends with the piston being located proximate the first end 208. The current continues to decrease to 0 Amps, configuring the valve 260 in the first state and preventing further flow from the port 262 to the port 264 back to the reservoir 220.

In the embodiment shown, there is a short delay period $t_{du}$ between the end of the second ramped portion 408 of the waveform 400 at $t_4$ and the start of the first ramped portion 422 of the waveform 420 at $t_5$. Similarly there is a short delay period $t_{dd}$ between the end of the second ramped portion 426 of the waveform 420 at $t_8$ and the start of the first ramped portion of a subsequent upstroke waveform 410. In other embodiments the delay periods $t_{du}$ and $t_{dd}$ may be extended or omitted or may be calculated based on a calculated speed of the piston 204 during a previous upstroke or downstroke, for example.

The above described portions of the waveforms 400 and 420 respectively control the hydraulic pump 240 and the valve 260 to perform a single pumping cycle including an upstroke and a downstroke. As shown in FIG. 3, the process steps 306 and 308 may then be repeated to cause a continuous reciprocation of the cylinder rod 130 for continuous operation of the down-hole reciprocating pump 112 and the waveform 400 thus repeats at 410. Similarly the waveform 420 would also include repeating portions 422, 424, and 426.

In general the times $t_1$ to $t_8$ and the currents $i_u$, $i_{0u}$, $i_{0d}$ and $i_d$ may be adjusted to produce target upstroke and downstroke times and velocities of the piston 204. The times and current levels may be predetermined and set within the controller 270.

In the embodiments shown in FIG. 2 and FIG. 5, the hydraulic fluid lines 284 and 134 provide a direct connection between the pump 240 and the hydraulic cylinder 124, which may be implemented using hydraulic fluid line having a 1 to 1.25 inch (25 to 32 millimeter) bore, for example. The tee coupling 295 may be configured to provide a smooth bore between the fluid lines 284 and 134 and the fluid lines have no additional restrictions along the lines, thus improving the flow efficiency between the pump and the cylinder 124. In the embodiments shown, the fluid lines 284 and 134 do not cause the upstroke fluid flow to pass through the valve 260, which may reduce an upstroke efficiency. Additionally, while the hydraulic fluid line 284 may include a bend as shown in FIGS. 2 and 5, the bend may be configured to have a bend radius R that is sized to reduce flow losses within the hydraulic fluid line. For example, the bend radius may be at least about 1 inch or 25 millimeters. The hydraulic fluid lines 284, 134, and 288 may be implemented using steel lines or steel braided hydraulic lines with appropriate pressure rating and resistance to environmental factors such as UV exposure, high temperature and abrasion.

In some embodiments, an additional electrically actuated check valve 298 may be optionally disposed between the outlet of the pump 244 and the hydraulic fluid port 132.

In some embodiments an optional additional check valve 298 may be disposed inline with the hydraulic fluid line 284. During operation of the lift apparatus 100 the valve 298 will be configured fully open by the controller 270, as shown in FIG. 2. The check function of the valve 298 need only be actuated when it is required to hold the piston 204 under loading by the sucker rod 114 and down-hole reciprocating pump 112 while not supported by the frame 120. The additional check valve 298 may be required in implementations where the pump 240 has significant leakage through the pump under load, which may flow back to the reservoir 220 via a line 299. As an example, during an operating stoppage of the lift apparatus 100, the valve 298 may be electrically actuated by the controller 270 to prevent flow of hydraulic fluid back into the outlet 244 of the hydraulic pump 240.

As noted above, the hydraulic cylinder 124 may have separate hydraulic fluid ports and the portion 134 of the hydraulic fluid line is a common shared line for both upstroke and downstroke fluid flows. However in other embodiments the hydraulic fluid line 134 may be replaced by separate hydraulic fluid lines between the hydraulic pump 240 and the hydraulic cylinder 124 and between the valve 260 and the hydraulic cylinder.

Figure 6:
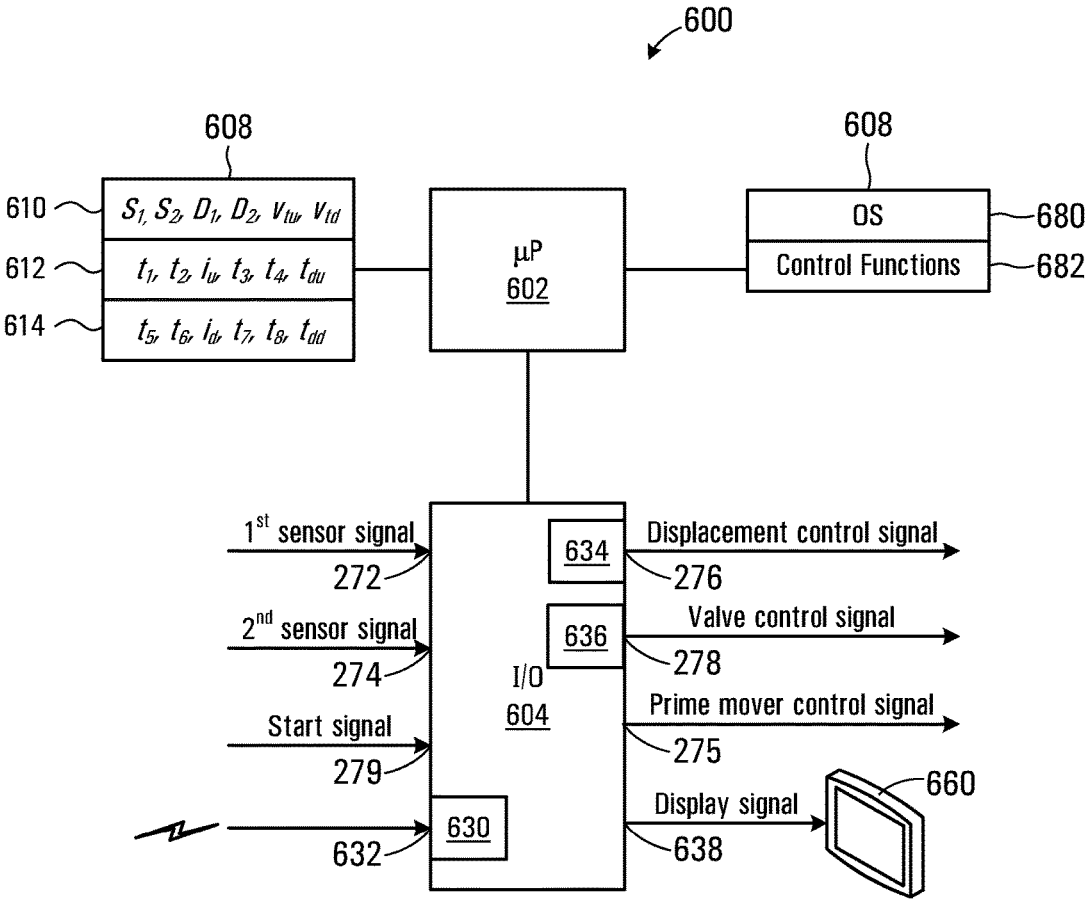
FIG. 6 is a schematic view of a processor circuit for implementing a controller of the lift apparatus shown in FIG. 2 and FIG. 5.

In one embodiment the controller 270 may be implemented using a microcontroller circuit or other microprocessor based control circuit. Referring to FIG. 6, a processor circuit for implementing the controller 270 is shown at 600. The processor circuit 600 includes a microprocessor 602, an input/output (I/O) 604, a program memory 606, and a parameter memory 608, all of which are in communication with the microprocessor 602. The microprocessor 602 executes program instructions stored in the program memory 606 to generate the displacement control signal and the valve control signal.

The I/O 604 includes the input 272 for receiving the first sensor signal from output 294 of the first sensor 290 and the input 274 for receiving the second sensor signal from output 296 of the second sensor 292. Depending on the selected type of sensors, the sensor signals may be digital signals producing a binary "1" when the piston 204 is proximate the respective sensor and a "0" otherwise. Alternatively, if the proximity sensors 290 and 292 produce analog signals at the outputs 294 and 296, the I/O 304 may include an analog-to-digital converter interface for converting the signals to a format that can be processed by the processor circuit 600. The I/O 604 also includes the input 274 for receiving the start signal. In this embodiment the I/O 604 also includes a network interface 630 having a port 632 for connecting to a network such as a wireless 802.11 network, a cellular data network, or a wired network.

The I/O 604 also includes an interface 634 having the output 276 for producing the displacement control signal and an interface 636 having the output 278 for producing the valve control signal. In this embodiment, the interfaces 634 and 636 would generally be digital-to-analog converters operable to produce a 24 VDC pulse width modulated signal at the respective outputs 276 and 278 regulated to produce a controlled current for driving the input 248 of the hydraulic pump 240 or the input 268 of the solenoid 266 of the valve 260. The I/O interface 302 also includes an output 275 for producing a prime mover control signal for controlling the prime mover 256. The I/O interface 302 may further include an output 638 for generating a display signal for displaying information related to the operation of the lift apparatus 100 on a display 660.

The program memory 606 has locations 680 storing codes for implementing an embedded controller operating system (OS) such as Linux®. The program codes may be generated using a visual programming language such as PLUS+1® GUIDE, produced by Danfoss A/S Denmark. The program memory 606 also includes locations 682 storing codes for causing the microprocessor 602 to implement functions related to controlling the lift apparatus 100. The parameter memory 608 stores various parameters related to the functioning and configuration of the lift apparatus 100. For example, in the embodiment shown, values of the parameters $S_1$ and $S_2$ defining the locations of the first and second sensors 290 and 292 and distances $D_1$, $D_2$, and $D_3$ related to the operating stroke of the piston 204 may be saved in a location 610 of the parameter memory 608. A target piston velocity for the upstroke $v_{tu}$ and downstroke $v_{td}$ may also be saved in the location 610. Parameter values for timing of the waveform 400 and parameter values for timing of the waveform 420 may be saved in the location 614 of the parameter memory 608. In one embodiment the target piston velocity values of $v_{tu}$ and $v_{td}$ may be received through operator input via an input device connected to the (I/O) 604 or remotely via the network interface 630. In other embodiments the desired piston upstroke and downstroke may be defining in terms of an upstroke time and downstroke time, which is essentially equivalent to the target piston velocity values.

Figure 7:
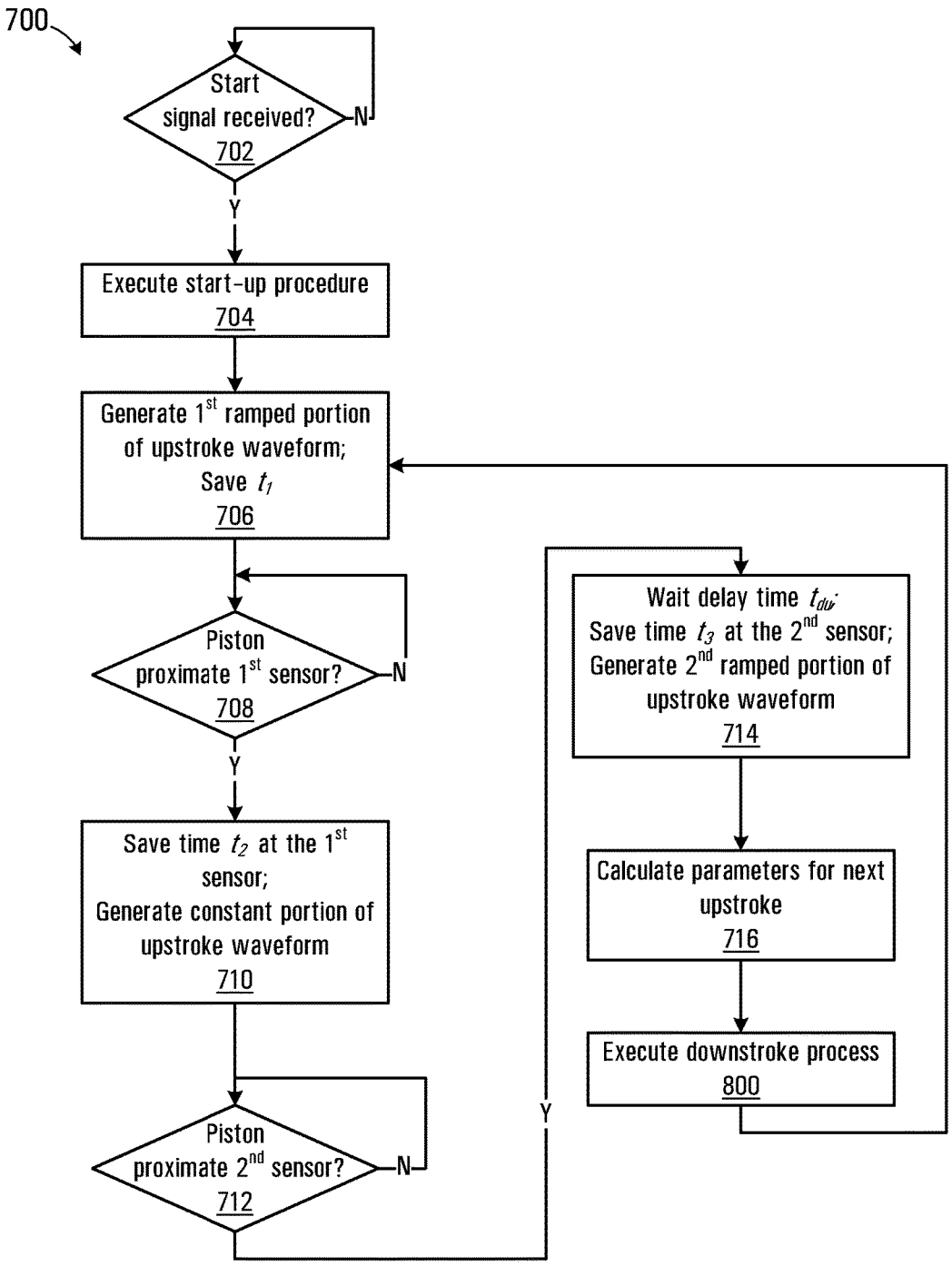
FIG. 7 is a process flowchart showing blocks of code for directing the controller processor circuit shown in FIG. 6 to execute an upstroke process.

Referring to FIG. 7, a flowchart depicting blocks of code for directing the processor circuit 600 to control the upstroke of the lift apparatus 100 in accordance with one disclosed embodiment is shown generally at 700. The blocks generally represent codes that may be read from the locations 682 of the program memory 606. The actual codes for implementing each block may be written in any suitable program language, such as C, C++, C#, Java, and/or assembly code, for example.

The process 700 begins at block 702, which directs the microprocessor 602 to determine whether a start signal has been received at the input 279. If a start signal has not yet been received the processor circuit 600 remains in an idle state and the execution returns to the beginning of block 702. When a start signal is received, block 702 directs the microprocessor 602 to block 704, which directs the microprocessor 602 to execute the start-up process described above in connection with FIG. 3, which involves directing the microprocessor to produce a displacement control signal having a current less than or equal to $i_{0u}$ at the output 276, a valve control signal at the output 278 having a current less than or equal to $i_{0d}$, and to generate a prime mover control signal at the output 275 for causing the prime mover 256 to be started.

Block 704 may further direct the microprocessor 602 to initialize values for various operating parameters stored in the parameter memory 608. For example, pre-determined initial values of the timing parameters $t_1$, $t_2$, $t_3$, and $t_4$ and the current level $i_u$ for the waveform 400 shown in FIG. 4 may be stored in the location 612 of parameter memory 608.

Figure 4:
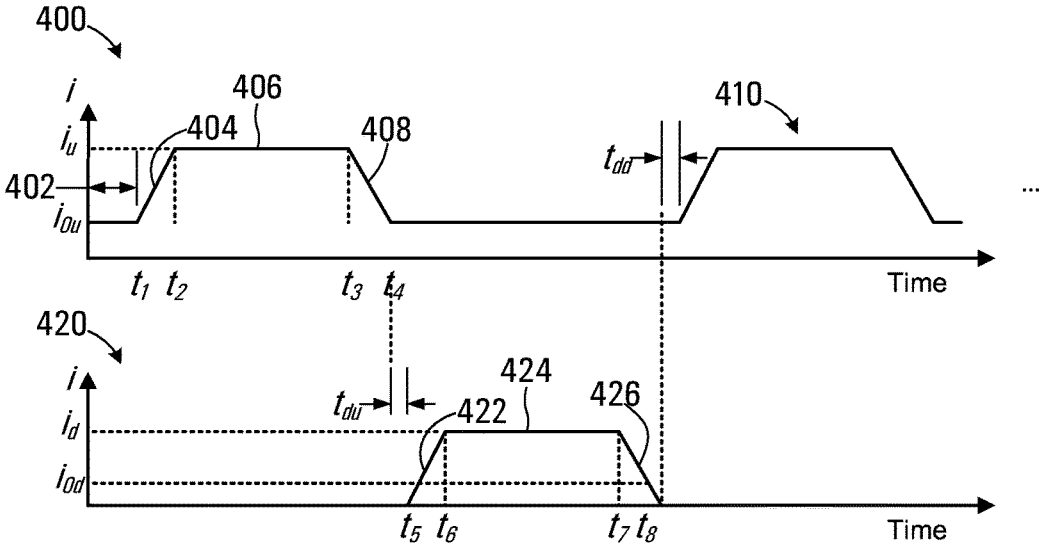
FIG. 4 is a graphical depiction of waveforms for controlling operation of components of the lift apparatus shown in FIG. 2.
Figure 5:
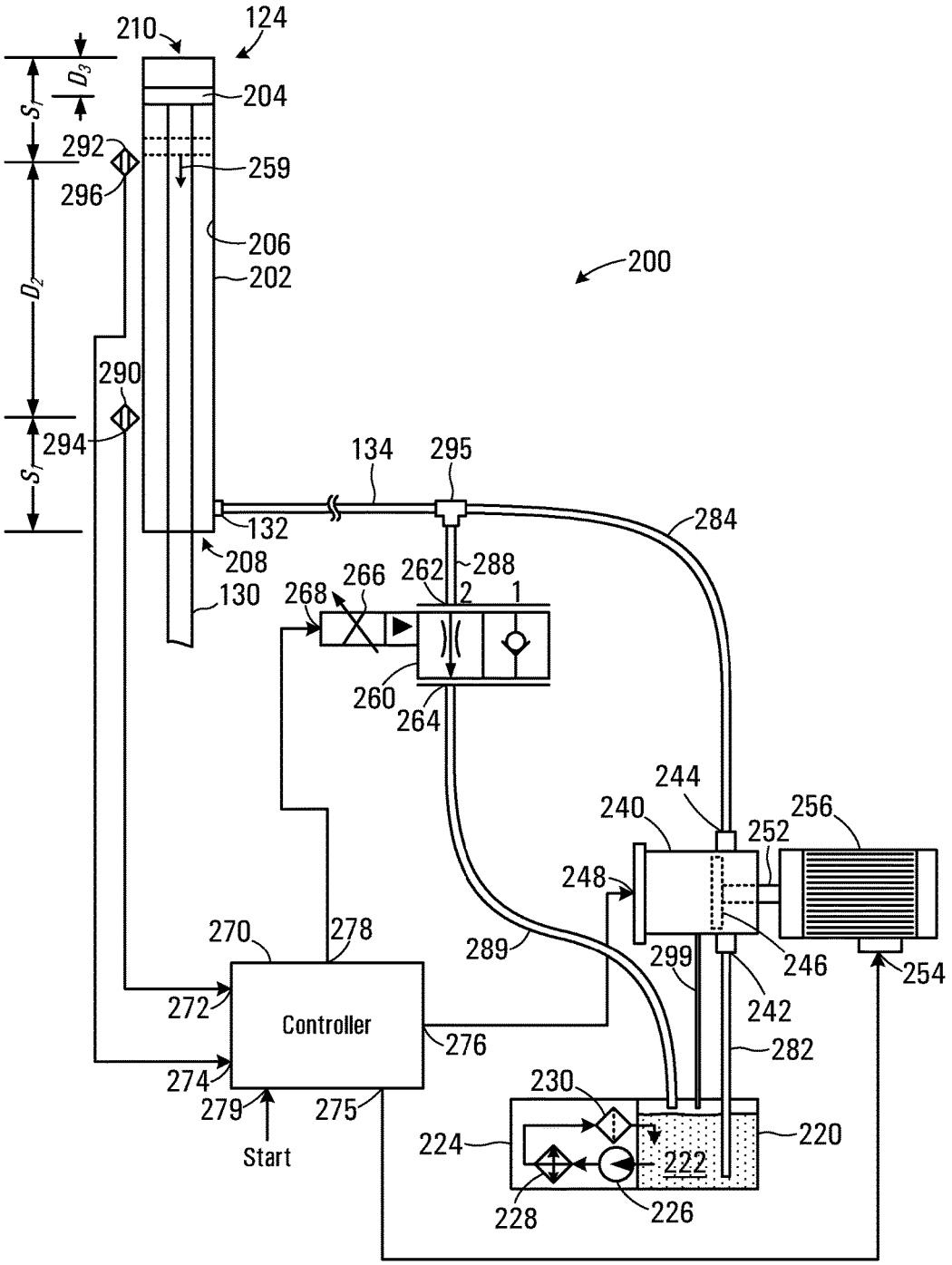
FIG. 5 is a schematic view of a fluid circuit of the lift apparatus of FIG. 1 while executing a downstroke process.

Block 706 then directs the microprocessor 602 to generate the first ramped portion 404 of the waveform 400 shown in FIG. 4. In one embodiment the first ramped portion 404 is generated based on the timing parameters $t_1$, $t_2$ and the current level $i_u$ stored in the location 612 of parameter memory 608. Block 706 directs the microprocessor 602 to calculate a rate of increase of the first ramped portion 404 as follows:

$$\Delta i_1 = \frac{i_u}{t_2 - t_1} \qquad \text{Eqn 1}$$

where $\Delta i_1$ is calculated in units of Amps/second. In one embodiment $t_2 - t_1$ is about 1500 milliseconds. Block 706 thus directs the microprocessor 602 to cause the interface 634 to produce a first ramped portion 404 of the displacement control signal at the output 276 that increases at a rate of $\Delta i_1$ Amps/second. Referring back to FIG. 2, the first ramped portion 404 causes the swashplate 246 to be progressively angled at a greater angle $\alpha$, causing an increasing flow rate at the outlet 244 that accelerates the piston 204 upwardly away from the first end 208 and towards the sensor 292. Block 706 also directs the microprocessor 602 to write the time $t_1$ at the actual start of the first ramped portion 404 to the location 612 of the parameter memory 608 and then directs the microprocessor to block 708.

Block 708 directs the microprocessor 602 to determine whether a signal has been received from the first sensor 290 indicating that the piston 204 is proximate the sensor. If no signal has been received from the first sensor 290, the microprocessor 602 is directed to repeat block 708. If a signal is received from the first sensor 290, the microprocessor 602 is directed to block 710. Block 710 directs the microprocessor 602 to write a value for the time at which the proximity signal was received as a new value of $t_2$ in the location 612 of the parameter memory 608. The time $t_2$ thus represents a time at which the piston is located at a distance $S_1$ from the first end 208 of the hydraulic cylinder 124. Block 710 further directs the microprocessor 602 to cause the interface 634 to produce a constant displacement control signal having a current level $i_u$ at the output 276 for generating the constant portion 406 of the waveform 400. The current $i_u$ may be initially set to a slow default level for producing an initially slow and safe average velocity of the piston while starting up operations. Under these conditions, the swashplate 246 is held at a constant angle $\alpha$ and the fluid flow rate at the outlet 244 of the hydraulic pump 240 is thus also substantially constant, causing the piston 204 to move at substantially constant velocity over the distance $D_2$ in the direction 258.

The process 700 then continues at block 714, which directs the microprocessor 602 to determine whether a signal has been received from the second sensor 292 indicating that the piston 204 is proximate the sensor. If no signal has been received from the second sensor 292, the microprocessor 602 is directed to repeat block 712. If a signal is received from the second sensor 292, the piston 204 is located proximate the second sensor 292 and microprocessor 602 is directed to block 714. Block 714 directs the microprocessor to read a value for a delay period $t_{du}$ from the location 612 of the parameter memory 608 and to cause the interface 634 to continue to produce the constant output current level $i_u$ for a further period of time $t_{du}$. Block 714 then directs the microprocessor 602 to generate the second ramped portion 408 of the waveform 400 shown in FIG. 4. In this embodiment the second ramped portion 408 is generated based on the timing parameters $t_3$, $t_4$, and $i_u$ having values stored in the location 612 of parameter memory 608. Block 714 directs the microprocessor 602 to calculate a rate of decrease of the second ramped portion 408 as follows:

$$\Delta i_2 = \frac{i_u}{t_4 - t_3} \qquad \text{Eqn 2}$$

where $\Delta i_2$ will be a negative value calculated in units of Amps/second. Block 714 thus directs the microprocessor 602 to cause the interface 634 to produce a second ramped portion 408 of the displacement control signal at the output 276 that reduces at a rate of $\Delta i_2$ Amps/second. In one embodiment $t_4$–$t_3$ is about 600 milliseconds The delay period $t_{du}$ and the times $t_3$ and $t_4$ are initially calculated to ensure that the fluid flow at the outlet 244 of the hydraulic pump 240 is reduced to zero before the piston 204 reaches the second end 210 of the hydraulic cylinder 124. In one embodiment the delay period $t_{du}$ and the times $t_3$ and $t_4$ are calculated to cause the piston 204 to stop about 6 inches (15 centimeters) from the second end 210 for a margin of safety to reduce the chance of the piston 204 topping out in the cylinder 124, which could cause damage to the cylinder. In some embodiments, the delay period $t_{du}$ may be eliminated.

The process 700 then continues at block 716, which directs the microprocessor 602 to recalculate parameters for the upstroke based on the calculated velocity of the piston 204 during the current upstroke and to update these values for a subsequent upstroke. In one embodiment the following calculations may be performed:

$$\Delta v = \frac{D}{t_4 - t_1} - v_{tu} \qquad \text{Eqn 3}$$

where $v_{tu}$ is a target average velocity for the upstroke, D is the total piston travel distance ($D=D_1+D_2+D_3$) shown in FIGS. 2 and 5, and $\Delta v$ is the velocity variance from the target average velocity. The target average velocity $v_{tu}$ is saved in the location 610 of parameter memory 608. An updated constant current level $i_u$ is then calculated as follows:

$$i'_U = i_U\left[1 - \frac{\Delta v}{v_d}\right] \qquad \text{Eqn 4}$$

where $i'_u$ is the constant current level based on the previous upstroke to be used for the next upstroke. The constant current level $i'_u$ is thus increased if the previous upstroke was slower than the target average velocity $v_{tu}$ and decreased if the previous upstroke was faster than the target average velocity $v_{tu}$. Block 714 directs the microprocessor 602 to save the updated the constant current value $i'_u$ in the location 612 of parameter memory 608 as the constant current level $i_u$ for the next upstroke. Block 716 then directs the microprocessor 602 to block 800, which causes the microprocessor 602 to execute a downstroke process (shown in detail in FIG. 8). Following the downstroke process 800, the microprocessor 602 is directed back to block 706 for the next upstroke and blocks 706-714 are repeated. At blocks 706, 710, and 714, the updated value of $i_u$ is used to calculate the first and second ramped portions 404 and 408 and the constant portion 406, thus targeting the target velocity $v_{tu}$ for the upstroke. For each successive upstroke, the actual average velocity of the piston should therefor converge toward the target average velocity $v_{tu}$. Additionally, should the load conditions downhole change, the controller processor circuit 600 of the lift apparatus 100 will automatically adapt to the changing conditions and return to operation at or near the target average velocity $v_{tu}$ for the upstroke. The processor circuit 600 is thus operably configured to generate the first and second ramped portions 404 and 408 of the waveform for the upstroke based on the first and second signals received from the first and second sensors 290 and 292 during a previous upstroke of the piston. In other embodiments the target average velocity $v_{tu}$ may be based on a desired number of strokes per minute or spm (upstroke and downstroke).

Figure 8:
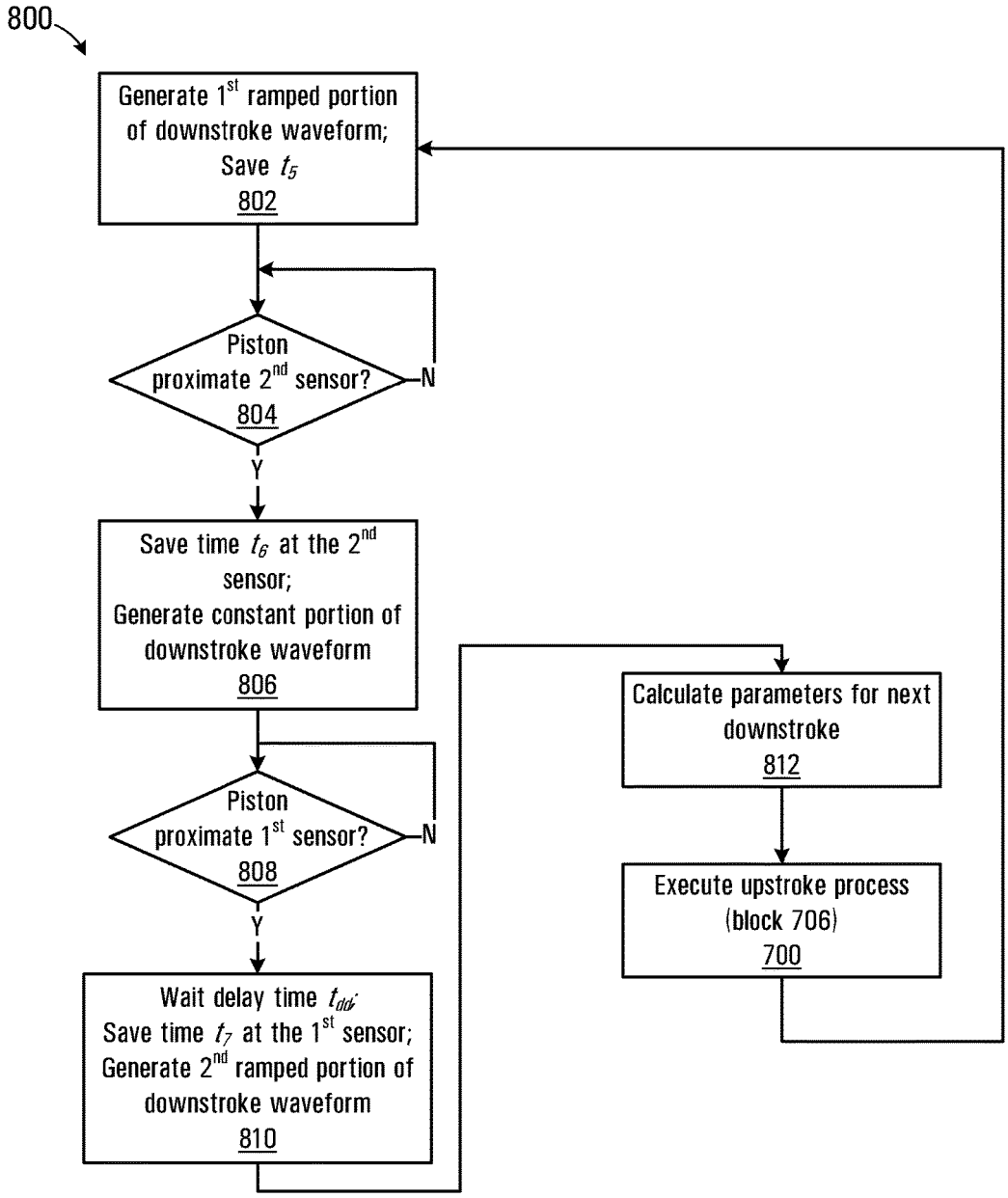
FIG. 8 is a process flowchart showing blocks of code for directing the controller processor circuit shown in FIG. 6 to execute a downstroke process.

Referring to FIG. 8, a flowchart depicting blocks of code for directing the processor circuit 600 to control the downstroke of the lift apparatus 100 in accordance with one disclosed embodiment is shown generally at 800. The process 800 begins at block 802, which directs the microprocessor 602 to generate the first ramped portion 422 of the waveform 420 shown in FIG. 4. In this embodiment the first ramped portion 422 is generated based on the timing parameters $t_5$, $t_6$, and the current level $i_d$ stored in the location 614 of parameter memory 608. Block 802 directs the microprocessor 602 to calculate a rate of increase of the first ramped portion 422 as follows:

$$\Delta i_3 = \frac{i_d}{t_6 - t_5} \quad \text{Eqn 5}$$

where $\Delta i_3$ is calculated in units of Amps/second. Block 802 thus directs the microprocessor 602 to cause the interface 636 to produce a first ramped portion 422 of the valve control signal at the output 278 that increases at a rate of $\Delta i_3$ Amps/second. In one embodiment $t_6$–$t_5$ is about 2400 milliseconds Referring back to FIG. 5, when the first ramped portion 422 reaches the current level $i_{0d}$, the valve 260 changes state from the checkvalve state "1" to the orifice valve state "2" and the orifice valve permits a flow of hydraulic fluid from the hydraulic cylinder 124 through the hydraulic fluid port 132 and lines 134, 288 through the valve 260 and back to the reservoir 220 via the fluid line 289. A rate of flow is determined by the current level of the first ramped portion 422, which increases at the rate $\Delta i_3$ allowing the piston 204 to accelerate away from the first end 208 toward the second end 210. The sucker rod 114 and downhole reciprocating pump 112 act as a significant load on the piston 204 for causing the downward motion. Block 802 also directs the microprocessor 602 to write the time $t_5$ at the actual start of the first ramped portion 422 to the location 614 of the parameter memory 608 and then directs the microprocessor to block 804.

Block 804 directs the microprocessor 602 to determine whether a signal has been received from the second sensor 292 indicating that the piston 204 is proximate the sensor. If no signal has been received from the second sensor 292, the microprocessor 602 is directed back to repeat block 804. If a signal is received from the second sensor 292, the microprocessor 602 is directed to block 806.

Block 806 directs the microprocessor 602 to write a value for the time at which the proximity signal was received as a new value of $t_6$ in the location 614 of the parameter memory 608. The time $t_6$ thus represents a time at which the piston is located at a distance $S_2$ from the second end 210 of the hydraulic cylinder 124. Block 806 further directs the microprocessor 602 to cause the interface 636 to produce a constant valve control signal having a current level $i_d$ at the output 278 for generating the constant portion 424 of the waveform 420. Under these conditions, the orifice of the valve 260 is held at a constant opening and the fluid flow rate at the port 264 is thus restricted to a substantially constant flow rate, causing the piston 204 to move at substantially constant velocity over the distance $D_2$ in the downward direction 259.

The process 800 then continues at block 808, which directs the microprocessor 602 to determine whether a signal has been received from the first sensor 290 indicating that the piston 204 is proximate the sensor. If no signal has been received from the first sensor 290, the microprocessor 602 is directed to repeat block 808. If a signal is received from the first sensor 290, the piston 204 is located proximate the first sensor and microprocessor 602 is directed to block 810.

Block 810 directs the microprocessor to read a value for a delay period $t_{dd}$ from the location 614 of the parameter memory 608 and to cause the interface 636 to continue to produce the constant output current level $i_d$ for a further period of time $t_{dd}$. Block 810 then directs the microprocessor 602 to generate the second ramped portion 426 of the waveform 400 shown in FIG. 4. In this embodiment the second ramped portion 426 is generated based on the timing parameters $t_7$, $t_8$, and $i_d$ having values stored in the location 614 of parameter memory 608. Block 810 further directs the microprocessor 602 to calculate a rate of decrease of the second ramped portion 426 as follows:

$$\Delta i_4 = \frac{i_d}{t_8 - t_7} \quad \text{Eqn 6}$$

where $\Delta i_4$ will be a negative value calculated in units of Amps/second. Block 810 thus directs the microprocessor 602 to cause the interface 636 to produce a second ramped portion 426 of the displacement control signal at the output 278 that reduces at a rate of $\Delta i_4$ Amps/second. In one embodiment $t_8$–$t_7$ is about 1500 milliseconds The delay period $t_{dd}$ and the times $t_7$ and $t_8$ are initially calculated to ensure that the fluid flow at the port 264 of the valve 260 is reduced to zero before the piston 204 reaches the first end 208 of the hydraulic cylinder 124. In one embodiment the delay period $t_{dd}$ and the times $t_7$ and $t_8$ are calculated to cause the piston 204 to stop about 3 inches (7.5 centimeters) from the first end 208 for a margin of safety to reduce the chance of the piston 204 bottoming out in the cylinder 124, which could cause damage to the cylinder. In some embodiments, the delay period $t_{dd}$ may be eliminated.

The process 800 then continues at block 812, which directs the microprocessor 602 to recalculate parameters for the downstroke based on the calculated velocity of the piston 204 during the current downstroke and to update these values for a subsequent downstroke. In one embodiment the following calculations may be performed:

$$\Delta v = \frac{D}{t_8 - t_7} - v_{td} \quad \text{Eqn 7}$$

where $v_{td}$ is a target average velocity for the downstroke, D is the total piston travel distance, and $\Delta v$ is the velocity variance from the target average velocity $v_{td}$. The target average velocity $v_{td}$ is saved in the location 610 of parameter memory 608. An updated constant current level $i_d$ is then calculated as follows:

$$i'_d = i_d\left[1 - \frac{\Delta v}{v_{td}}\right] \quad \text{Eqn 8}$$

where $i'_d$ is the constant current level of the waveform 420 based on the previous downstroke to be used for the next downstroke. The constant current level $i'_d$ is thus increased if the previous downstroke was slower than the target average velocity $v_{td}$ and decreased if the previous downstroke was faster than the target average velocity $v_{td}$. Block 812 also directs the microprocessor 602 to save the updated constant current value $i'_d$ in the location 614 of parameter memory 608 as the constant current value $i_d$ for the next downstroke. Block 812 then directs the microprocessor 602 to block 700, which causes the microprocessor 602 to again execute the downstroke process starting at block 706 (as shown in FIG. 7). Following the next upstroke, the microprocessor 602 is directed back to block 802 for the next downstroke and blocks 802-812 are again repeated. At blocks 802, 806, and 810 the updated value of $i_d$ is used to calculate the first and second ramped portions 422 and 426 and the constant portion 424, thus converging on the target velocity $v_{td}$ for the next downstroke. For each successive downstroke, the actual average velocity of the piston should therefor get closer to the target average velocity $v_{td}$. Additionally, should the load conditions downhole change, the controller processor circuit 600 of the lift apparatus 100 will automatically adapt to the changing conditions and return to operation at or near the target average velocity $v_{td}$ for a subsequent downstroke. The processor circuit 600 is thus operably configured to generate the first and second ramped portions 422 and 426 of the waveform 420 for the downstroke based on the first and second signals received from the first and second sensors 290 and 292 during a previous downstroke of the piston.

In one embodiment, conditions such as load, viscosity, temperature and friction etc. are compensated by the processes 700 and 800 such that the operation reaches a desired stroke per minute (spm) within about 30 strokes of the lift apparatus 100. While the above upstroke process 7090 and downstroke process 800 have been described as performing average velocities $v_{tu}$ and $v_{td}$, other calculations for providing feedback based on a pervious upstroke or downstroke may be performed for adjusting the parameters for the next upstroke or downstroke. Alternatively, the waveforms 400 and 420 may be adjusted during an upstroke, for example by transitioning from the first ramped portion 404 to the constant portion 406 when the proximity signal is received from the first sensor 290, thus performing near real-time control of the upstroke and downstroke rather than the learning based approach described above. The signals produced by the first sensor 290 and second sensor 292 indicating proximity of the piston may thus be used to generate the displacement control signal and the valve control signal.

Since the hydraulic pump 240 is connected to the hydraulic cylinder 124 directly through the hydraulic fluid lines 284, and 134 and not though a valve (such as the valve 260), the disclosed lift apparatus 100 provides less flow resistance during the upstroke, thus reducing flow losses within the apparatus. Further, driving the pump 240 using a substantially constant rotational drive prime mover 256 reduces complexity associated with controlling the speed of prime mover to control the upstroke. The necessary control is provided by the variable displacement pump, which produces a controlled constant flow in response to receiving a constant displacement control signal. The upstroke of the piston 204 is controlled via the hydraulic pump 240 using a single displacement control signal and the downstroke of the piston is controlled by controlling the valve 260 through a single valve control signal, reducing control complexity for the disclosed lift apparatus 100.

While specific embodiments have been described and illustrated, such embodiments should be considered illustrative of the invention only and not as limiting the invention as construed in accordance with the accompanying claims.

What is claimed is:

1. A lift apparatus for driving a downhole reciprocating pump, the apparatus comprising:

a hydraulic cylinder having a piston and a hydraulic fluid port, the piston being coupled to a rod for driving the reciprocating pump, the piston being moveable between first and second ends of the cylinder in response to a flow of hydraulic fluid through the hydraulic fluid port;

a variable displacement hydraulic pump coupled to receive a substantially constant rotational drive from a prime mover for operating the hydraulic pump, the hydraulic pump having an outlet and being responsive to a displacement control signal to draw hydraulic fluid from a reservoir and to produce a controlled flow of hydraulic fluid at the outlet;

a hydraulic fluid line connected to deliver hydraulic fluid from the outlet of the hydraulic pump through the hydraulic fluid port to the cylinder for causing the piston to move through an upstroke away from the first end and toward the second end of the cylinder;

a valve connected between the hydraulic fluid port and the reservoir, the valve being responsive to a valve control signal for controlling discharge of hydraulic fluid from the hydraulic fluid port of the cylinder back to the reservoir to facilitate movement of the piston through a downstroke away from the second end toward the first end of the cylinder;

wherein the valve is operable to prevent flow of hydraulic fluid through the valve during the upstroke and wherein the hydraulic pump is operable to prevent flow of hydraulic fluid back into the outlet of the hydraulic pump during the downstroke, and further comprising:

a first sensor located proximate the first end of the cylinder and operable to produce a first signal indicating a proximity of the piston to the first sensor;

a second sensor located proximate the second end of the cylinder and operable to produce a second signal indicating a proximity of the piston to the second sensor; and a controller operably configured to generate the displacement control signal and the valve control signal in response to receiving the first signal and the second signal.

2. The apparatus of claim 1 wherein the first and second sensors are positioned proximate to but spaced inwardly from the respective first and second ends of the cylinder to cause the first and second signals to be generated in when the piston is in proximity to the respective first and second ends of the cylinder.

3. The apparatus of claim 1 wherein the controller is operably configured to generate a displacement control signal having a time varying waveform for controlling the upstroke, the waveform including:

a first ramped portion that causes the hydraulic pump to deliver an increasing flow of hydraulic fluid for accelerating the piston away from the first end of the cylinder;

a constant portion that causes the hydraulic pump to deliver a substantially constant flow for moving the piston at a substantially constant velocity; and a second ramped portion that causes the hydraulic pump to deliver a reducing flow for decelerating the piston as the piston approaches the second end of the cylinder.

4. The apparatus of claim 3 wherein the controller is operably configured to generate the constant portion of the waveform to target a desired velocity of the piston for the upstroke based on a calculated velocity of the piston during a previous upstroke of the piston, the velocity being calculated based on the first and second signals.

5. The apparatus of claim 4 wherein the controller is operably configured to receive operator input of one of the desired velocity and an upstroke time.

6. The apparatus of claim 3 wherein the controller is operably configured to, in response to receiving the second signal, commence the second ramped portion following a delay period.

7. The apparatus of claim 6 wherein the controller is operably configured to calculate the delay period based on a calculated velocity of the piston between the first and second sensors during a current upstroke of the piston.

8. The apparatus of claim 3 wherein the controller is operably configured to generate the first and second ramped portions of the waveform for the upstroke based on the first and second signals received during a previous upstroke of the piston.

9. The apparatus of claim 1 wherein the controller is operably configured to generate a valve control signal having a time varying waveform for controlling the downstroke, the waveform including:

a first ramped portion that causes the valve to permit an increasing flow of hydraulic fluid permitting the piston to accelerate away from the second end of the cylinder;

a constant portion that causes the valve to permit a substantially constant flow for moving the piston at a substantially constant velocity; and a second ramped portion that causes the valve to permit a reducing flow for decelerating the piston as the piston approaches the first end of the cylinder.

10. The apparatus of claim 9 wherein the controller is operably configured to generate the constant portion of the waveform for targeting a desired velocity of the piston for the downstroke based on a calculated velocity of the piston during a previous downstroke of the piston, the velocity being calculated based on the first and second signals.

11. The apparatus of claim 10 wherein the controller is operably configured to receive operator input of one of a desired velocity and a downstroke time.

12. The apparatus of claim 9 wherein the controller is operably configured to, in response to receiving the first signal, commence the second ramped portion following a delay period.

13. The apparatus of claim 12 wherein the controller is operably configured to calculate the delay period based on a calculated velocity of the piston between the second and first sensors during the downstroke of the piston.

14. The apparatus of claim 9 wherein the controller is operably configured to generate the first and second ramped portions of the waveform for the downstroke based on the first and second signals received during a previous downstroke of the piston.

15. A method for operating a pumpjack lift, the pumpjack comprising a hydraulic cylinder having a piston and a hydraulic fluid port, the piston being coupled to a rod for driving a downhole reciprocating pump, the method comprising:

producing a displacement control signal operable to cause a variable displacement hydraulic pump to draw hydraulic fluid from a reservoir and to produce a controlled flow of hydraulic fluid at an outlet of the hydraulic pump, the hydraulic pump being coupled to receive a substantially constant rotational drive from a prime mover;

delivering hydraulic fluid from the outlet through a hydraulic fluid line connected to the hydraulic fluid port of the cylinder to cause the piston to move through an upstroke away from a first end and toward a second end of the cylinder;

producing a valve control signal for controlling discharge of hydraulic fluid from the hydraulic fluid port of the cylinder through a valve connected between the hydraulic fluid port and the reservoir back to the reservoir to facilitate movement of the piston through a downstroke away from the second end and toward the first end of the cylinder;

preventing flow of hydraulic fluid through the valve during the upstroke and preventing flow of hydraulic fluid back into the outlet of the hydraulic pump during the downstroke; and wherein producing the displacement control signal comprises:

receiving a first signal indicating a proximity of the piston to a first sensor located proximate the first end of the cylinder;

receiving a second signal indicating a proximity of the piston to a second sensor located proximate the first end of the cylinder; and causing a controller to generate the displacement control signal and the valve control signal in response to receiving the first signal and the second signal.

16. The method of claim 15 wherein producing the displacement control signal comprises causing the controller to generate a displacement control signal having a time varying waveform for controlling the upstroke, the waveform including:

a first ramped portion that causes the hydraulic pump to deliver an increasing flow of hydraulic fluid for accelerating the piston away from the first end of the cylinder;

a constant portion that causes the hydraulic pump to deliver a substantially constant flow for moving the piston at a substantially constant velocity; and a second ramped portion that causes the hydraulic pump to deliver a reducing flow for decelerating the piston as the piston approaches the second end of the cylinder.

17. The method of claim 15 wherein producing the valve control signal comprises causing the controller to generate a valve control signal having a time varying waveform for controlling the downstroke, the waveform including:

a first ramped portion that causes the valve to permit an increasing flow of hydraulic fluid permitting the piston to accelerate away from the second end of the cylinder;

a constant portion that causes the valve to permit a substantially constant flow for moving the piston at a substantially constant velocity; and a second ramped portion that causes the valve to permit a reducing flow for decelerating the piston as the piston approaches the first end of the cylinder.

* * * * *